US006722406B2

(12) United States Patent
Wegman et al.

(10) Patent No.: US 6,722,406 B2
(45) Date of Patent: Apr. 20, 2004

(54) TONER FILLING APPARATUS AND METHOD INCLUDING A NOZZLE HAVING POST-CUTOFF VIBRATOR ASSEMBLY

(75) Inventors: Paul M. Wegman, Pittsford, NY (US); Mikhail Vaynshteyn, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/197,921

(22) Filed: Jul. 17, 2002

(65) Prior Publication Data

US 2004/0011425 A1 Jan. 22, 2004

(51) Int. Cl.[7] ..... B65B 1/04

(52) U.S. Cl. ..... 141/311 A; 141/67; 141/286; 141/256; 141/47; 222/232; 222/241

(58) Field of Search ..... 141/311 A, 59, 141/65, 256, 286, 67, 275, 44, 47, 68, 69, 93, 346, 383; 222/232, 241, 242, 243, 233

(56) References Cited

U.S. PATENT DOCUMENTS 3,720,241 A * 3/1973 Bryant et al. ..... 141/25
4,185,669 A * 1/1980 Jevakohoff ..... 141/59
4,561,759 A * 12/1985 Knott ..... 399/261
5,042,209 A * 8/1991 Furrer et al. ..... 451/76
5,244,019 A * 9/1993 Derby ..... 141/65
5,304,771 A * 4/1994 Griffin et al. ..... 219/121.63
5,328,261 A * 7/1994 Castano ..... 366/102
5,388,773 A * 2/1995 Perry ..... 241/19
5,618,177 A * 4/1997 Abbott ..... 433/88
6,021,821 A * 2/2000 Wegman ..... 141/93
6,098,677 A * 8/2000 Wegman et al. ..... 141/256
6,102,088 A * 8/2000 Wegman ..... 141/286
6,196,278 B1 * 3/2001 Wegman et al. ..... 141/65
6,340,036 B1 * 1/2002 Toyoizumi et al. ..... 141/275
6,347,648 B1 * 2/2002 Wegman et al. ..... 141/1
6,425,529 B1 * 7/2002 Reinsch et al. ..... 239/10
6,497,259 B1 * 12/2002 Wegman ..... 141/267

* cited by examiner

*Primary Examiner*—Gregory L. Huson
*Assistant Examiner*—Khoa D. Huynh
(74) *Attorney, Agent, or Firm*—Tallam I. Nguti

(57) ABSTRACT

A method and an apparatus are provided for cleanly cutting off filling of a container with toner without post-cutoff dribbling. The apparatus for the method includes (a) a conduit member having a discharging end; (b) a conveyor device for moving the toner from the hopper towards the container; and (c) a nozzle device including a positive and negative air pressure applying device, and a nozzle member for directing the toner to the container. The nozzle member has a first end connected to the discharge end of the conduit member and a second and opposite end for dispensing moving toner into the container. The nozzle member includes a post-cutoff controllable vibrator assembly connected to a controller for selectively enabling clean cutoff of powder flowing into the container without post-cutoff dribbling.

13 Claims, 5 Drawing Sheets

TONER FILLING APPARATUS AND METHOD INCLUDING A NOZZLE HAVING POST-CUTOFF VIBRATOR ASSEMBLY

RELATED APPLICATIONS

This application is related to U.S. application Ser. No. 10/198,398 entitled "Toner Filling Apparatus and Method Including An Anti-Dribbling Nozzle, Having Air Discharge Ports" filed on the same date herewith, now U.S. Pat. No. 6,640,845, and having at least one common inventor.

BACKGROUND OF THE INVENTION

This invention relates generally to apparatus for filling a container with dry particulate material, and more particularly concerns a filling apparatus including a filling nozzle having a post-cutoff vibrator assembly for achieving dribble-free, clean-cut filling of a container with particulate materials such as toner.

Currently when filling particulate materials, for example toners into toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner/funnel friction.

Toner containers for small low cost printers and copiers typically have a small opening into which the toner is to be added. Furthermore, the toner containers often have irregular shapes to conform to the allotted space within the copying machine. Therefore it becomes difficult to fill the toner container because of the small tube or nozzle required to fit into the small toner container opening and secondly for all the toner within the container to completely and cleanly fill the remote portions of the container before the container overflows.

In addition, during the filling operation there is some ordinarily undesirable continued discharge of toner (dribbling) from a conventional nozzle at cutoff or at the end of the filling cycle. In one embodiment, the end of a filling cycle occurs when the auger stops rotating and positive pressure normal to the axis of the auger is kept on for a fraction of a second longer in order to give some time for the toner or powder remaining in the nozzle to drop into the container. After that, the positive pressure is cut off and negative pressure in the form of a vacuum is turned on to "freeze" against the nozzle wall, any toner particles still remaining in the nozzle.

The main problem with this process is that when the positive pressure in the nozzle is switched to vacuum, this vacuum usually can firmly hold only a 3–5 mm thick layer of toner particles against the inner nozzle wall. Therefore in cases where the amount of toner remaining inside the nozzle is sufficient to create a layer thicker than 5 mm, the force of vacuum will be marginal (weak) for holding those toner particles on the top of the 5 mm layer surface. Thus, very often this force is not enough to hold them for more than 0.5–1 sec. Therefore, undesirable post-cutoff continued toner fallout or dribbling occurs when the filling apparatus indexes from one container to the next, thus resulting in dirty tops and/or sides of containers.

Conventional filling apparatus include conventional clean filling systems for use with such apparatus. Such a clean filling system is secured to filling line as well as to the toner conduit, and may be used to support a slide. The slide is connected to a tray or toner drip plate which slidably is fitted between the nozzle and the opening. A tray or drip plate in this position acts to prevent the spilling of powder during the indexing of containers. A housing which surrounds part of the—nozzle, provides a cavity or chamber which is sealed when the tray or drip plate is in its closed position.

SUMMARY OF THE INVENTION

In accordance with the present invention, there is provided a method and an apparatus for directing toner from a hopper containing a supply of toner to fill as well as cleanly cutoff filling of a container without post-cutoff dribbling. The apparatus for the method includes (a) a conduit member connected to the hopper and having a discharging end for permitting a toner to be moved therethrough; (b) a conveyor device located at least partially within the conduit member for moving the toner from the hopper in a toner moving direction towards the container; (c) a nozzle device including a nozzle member for directing the toner from the conveyor to cleanly fill the container. The nozzle member is mounted within a housing and has a first end connected to the discharge end of the conduit member and a second and opposite end for dispensing moving toner into the container. The nozzle member device includes a post-cutoff controllable vibrator assembly connected to a controller for selectively enabling clean cutoff of powder flowing into the container without post-cutoff dribbling.

BRIEF DESCRIPTION OF THE DRAWINGS

In the detailed description of the invention presented below, reference is made to the drawings in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
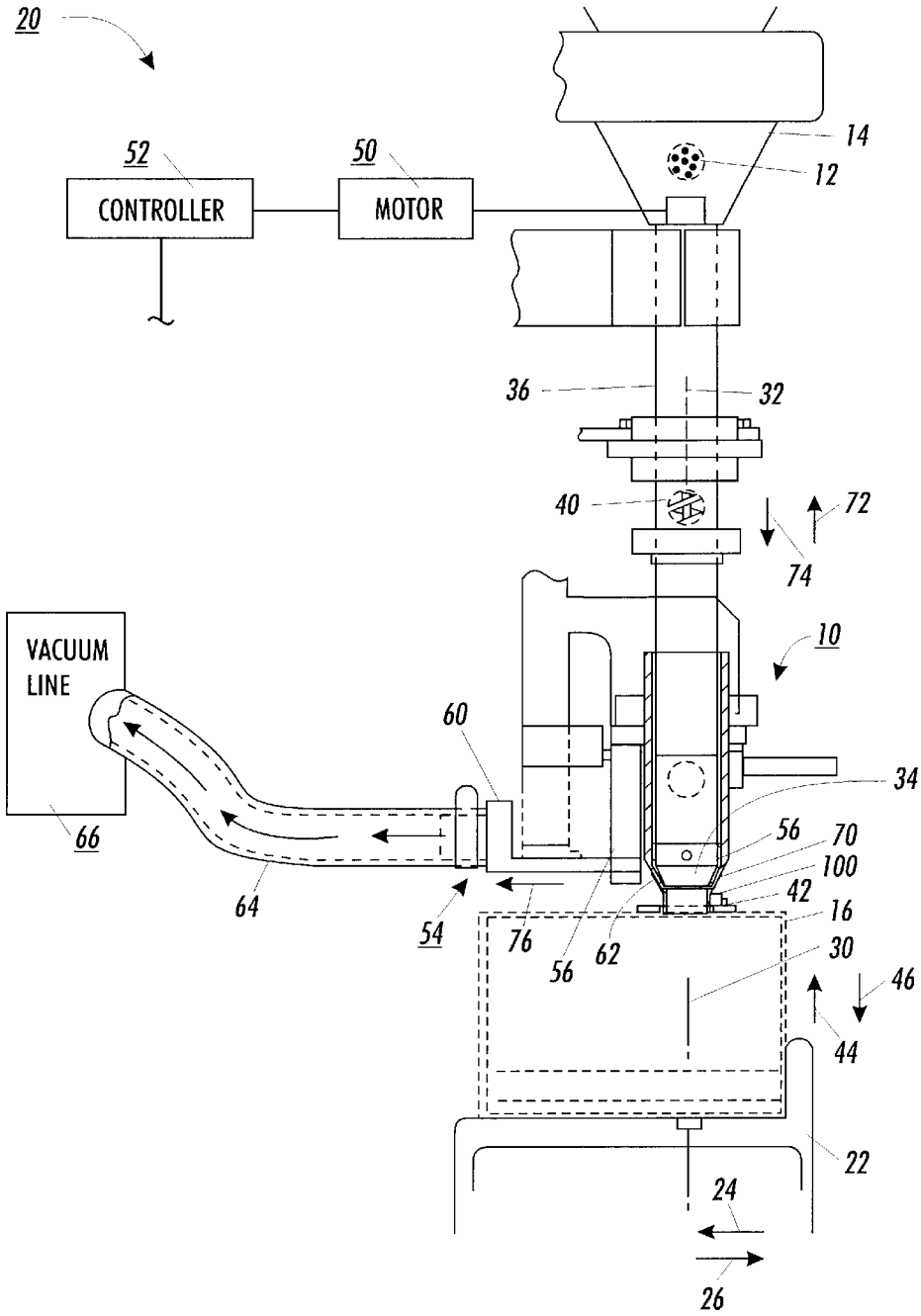
FIG. 1 is an elevational view of a toner container filling apparatus partially in section utilizing an anti-dribbling nozzle device having the post-cutoff vibrator assembly in accordance with the present invention.

According to the present invention and referring now to FIG. 1, powder filling apparatus 10 is shown. The powder filling apparatus 10 is used to convey powder 12 in the form of toner for use in a copier or printer from a hopper 14 to a container 16. The powder filling apparatus 10 is mounted to filling line 20 to permit for the filling of large production quantities of containers 16, the container 16 is mounted to a carrying device 22. The device 22 is movable in the direction of either arrow 24 or 26. The carrying device 22 serves to position container centerline 30 in alignment with apparatus centerline 32.

The powder filling apparatus 10 includes an anti-dribbling nozzle 34 (in accordance with the present invention, and to be described in detail below) which is used to direct the powder 12 into the container 16. The anti-dribbling nozzle 34 is connected to the hopper 14 by means of a conduit 36 in the form of a hollow tube or funnel. As shown in FIG. 1, the hopper 14 is positioned above the container 16 whereby gravity will assist in the flow of powder 12 toward the container 16. To optimize the flow of powder 12 toward the container 16, the powder filling apparatus 10 further includes a conveyor 40 positioned at least partially within the conduit 36 for assisting in the flow of the powder 12. The conveyor 40 is in the form of a spiral conveyor or auger. For example, the auger 40 may be in the form of a spiral shaped auger, which may include various geometries, such as, a straight or tapered helical screw. The auger closely conforms to the conduit.

The anti-dribbling nozzle 34 is insertable into opening 42 of the container 16. The insertion of the anti-dribbling nozzle 34 in the opening 42 may be accomplished in any suitable method. For example, the carrying device 22 and, consequently, the container 16 may be movable upward in the direction of arrow 44 for engagement with the anti-dribbling nozzle 34 and downward in the direction of arrow 46 for disengagement from the opening 42. The upward and downward motion of the device 22 and the container 16 permits the container 16 to be indexed in the direction of arrows 24 and 26.

To permit the filling of a number of containers 16, the flow of powder 12 from the hopper 14 must be halted by cutting off filling or powder flow, during the indexing of a filled container 16 from the fill position and during the indexing of the unfilled container 16 toward the filling position. In accordance with the present invention, it is important that halting powder flow by cutting off filling or powder flow be achieved cleanly without significant or any post-cutoff continued flow or dribbling.

Figure 3:
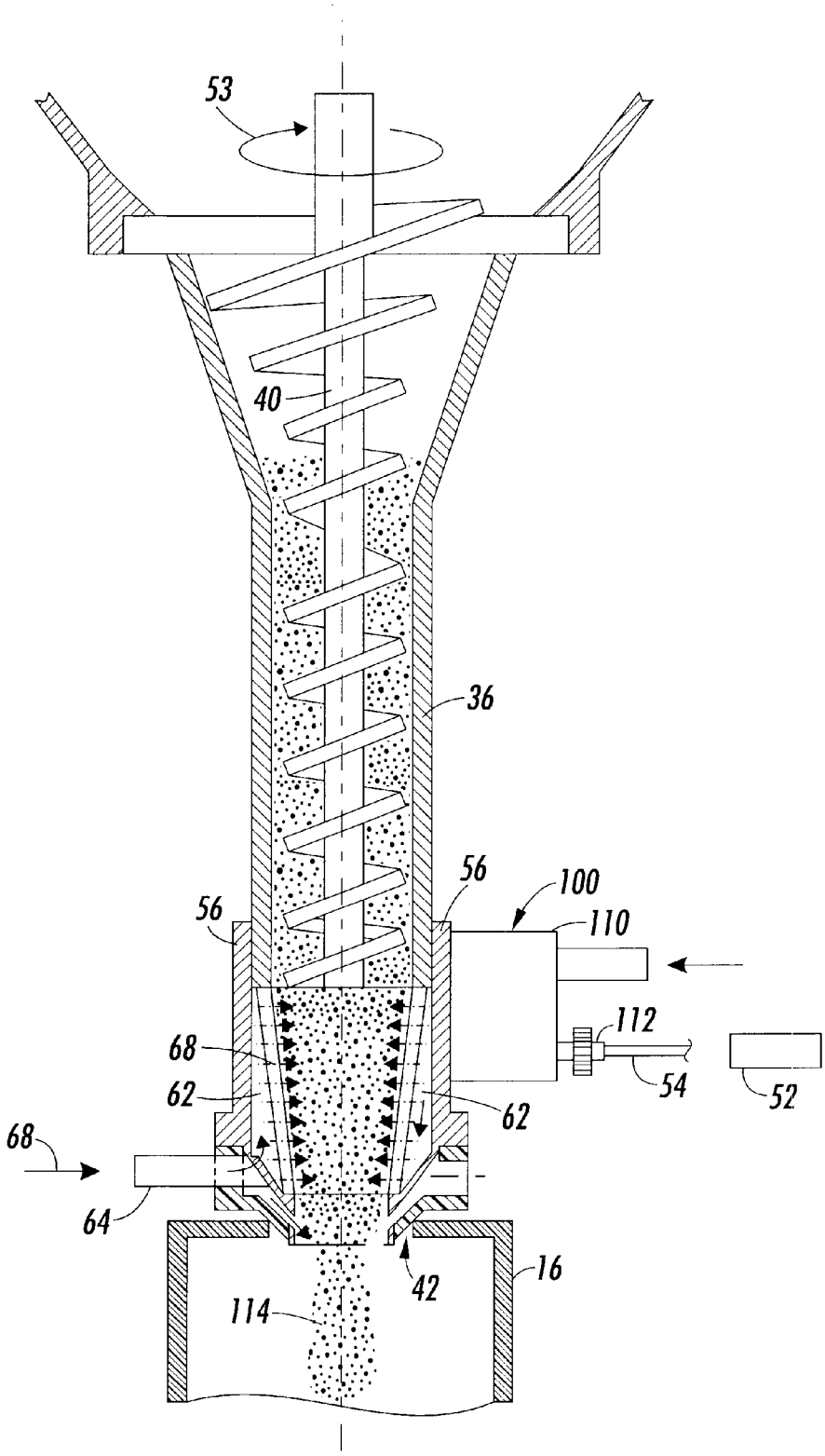
FIG. 3 is an elevational view of the anti-dribbling nozzle device of FIG. 2 during container filling.
Figure 4:
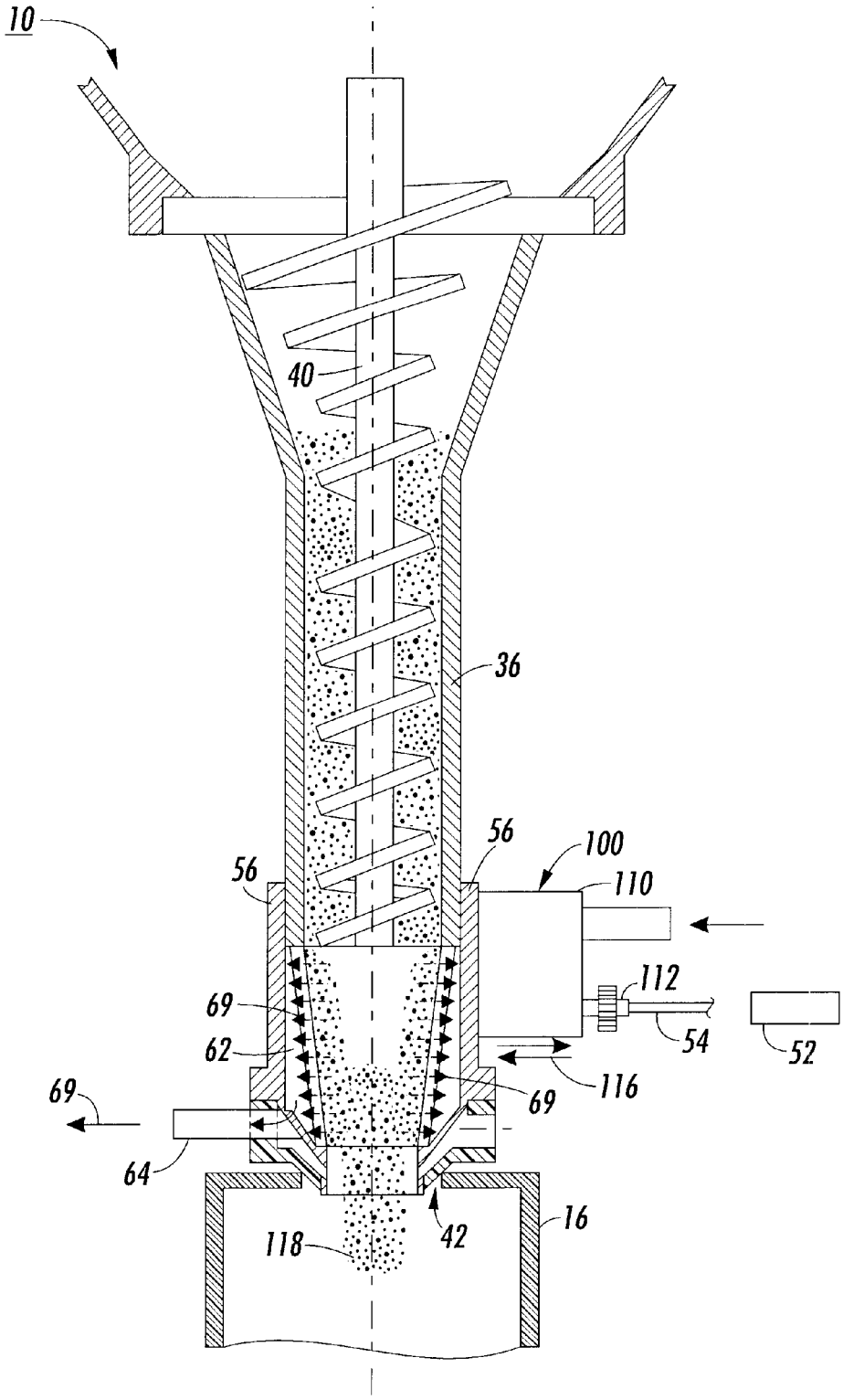
FIG. 4 is an elevational view of the anti-dribbling nozzle device of FIG. 2 during cutoff of container filling.
Figure 5:
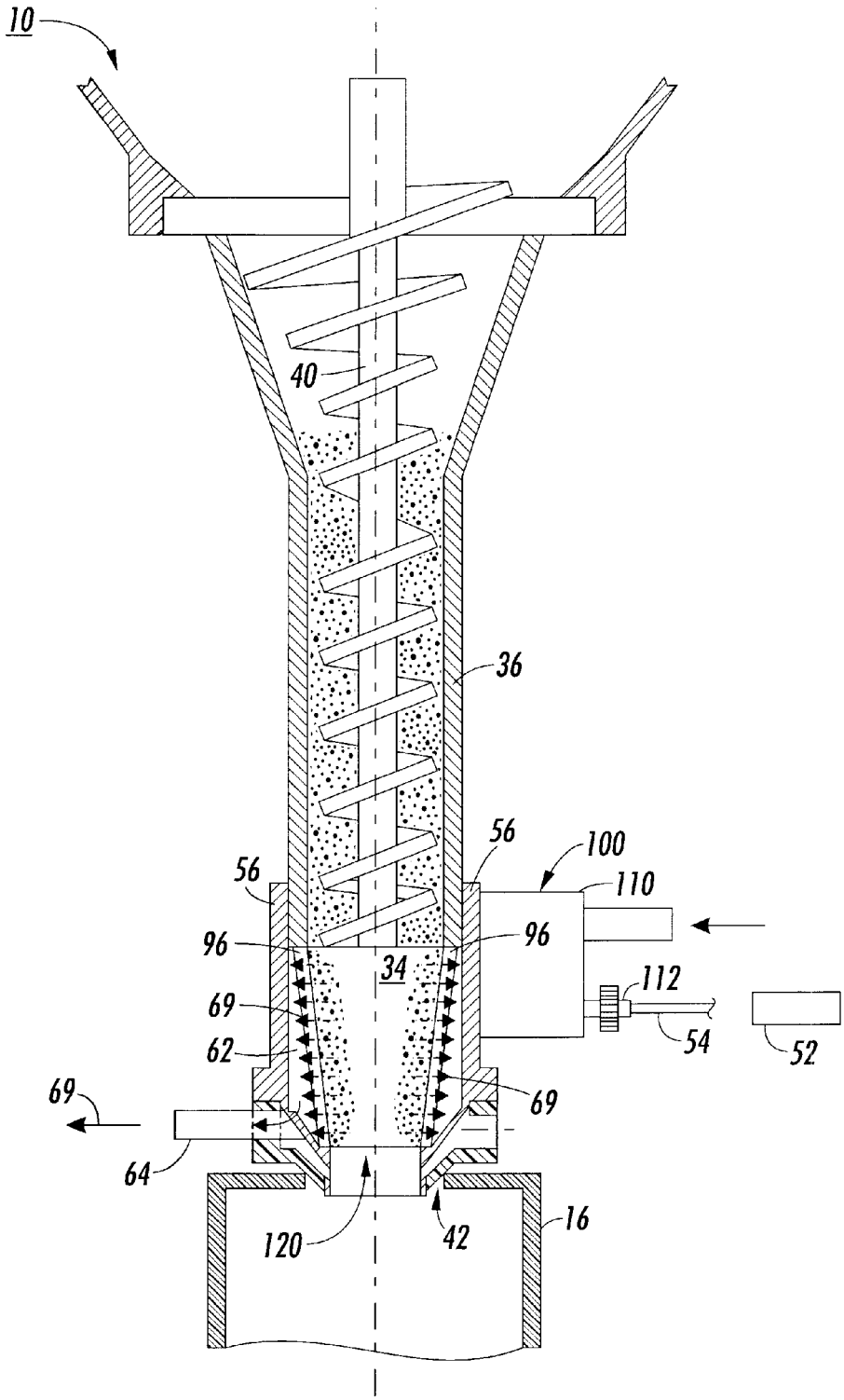
FIG. 5 is an elevational view of the anti-dribbling nozzle device of FIG. 2 post-cutoff showing a clean cutoff without dribbling in accordance with the present invention.

As shown in FIG. 1, the auger 40 may be rotated by any suitable method, i.e. by motor 50 connected to the auger 40 for rotating the auger 40 in a direction 53. The motor 50 is connected to a controller 52 which sends a signal to the motor 50 to stop the rotation of the auger 40 during indexing of the carrying device 22. The controller 52 is also connected by means 54 to the vibrator assembly 100 of the present invention. Accordingly, the primary flow of powder 12 is halted by the stopping of auger 40 within the conduit 36 and by the use of a valve therein (not shown). A housing 56 which surrounds part of the anti-dribbling nozzle 34, provides a cavity or chamber 62 which is sealed when the discharge opening 94 of the nozzle 34 is closed by suitable means (not shown). The chamber 62 is kept under vacuum via an air pressure applying device 64 that can apply positive pressure 68 (FIGS. 2 and 3) or negative pressure 69 (FIGS. 4 and 5). As shown in FIG. 1, the device 64 can also be a toner dust vacuum line 64 to an air pressure and vacuum source 66.

Figure 2:
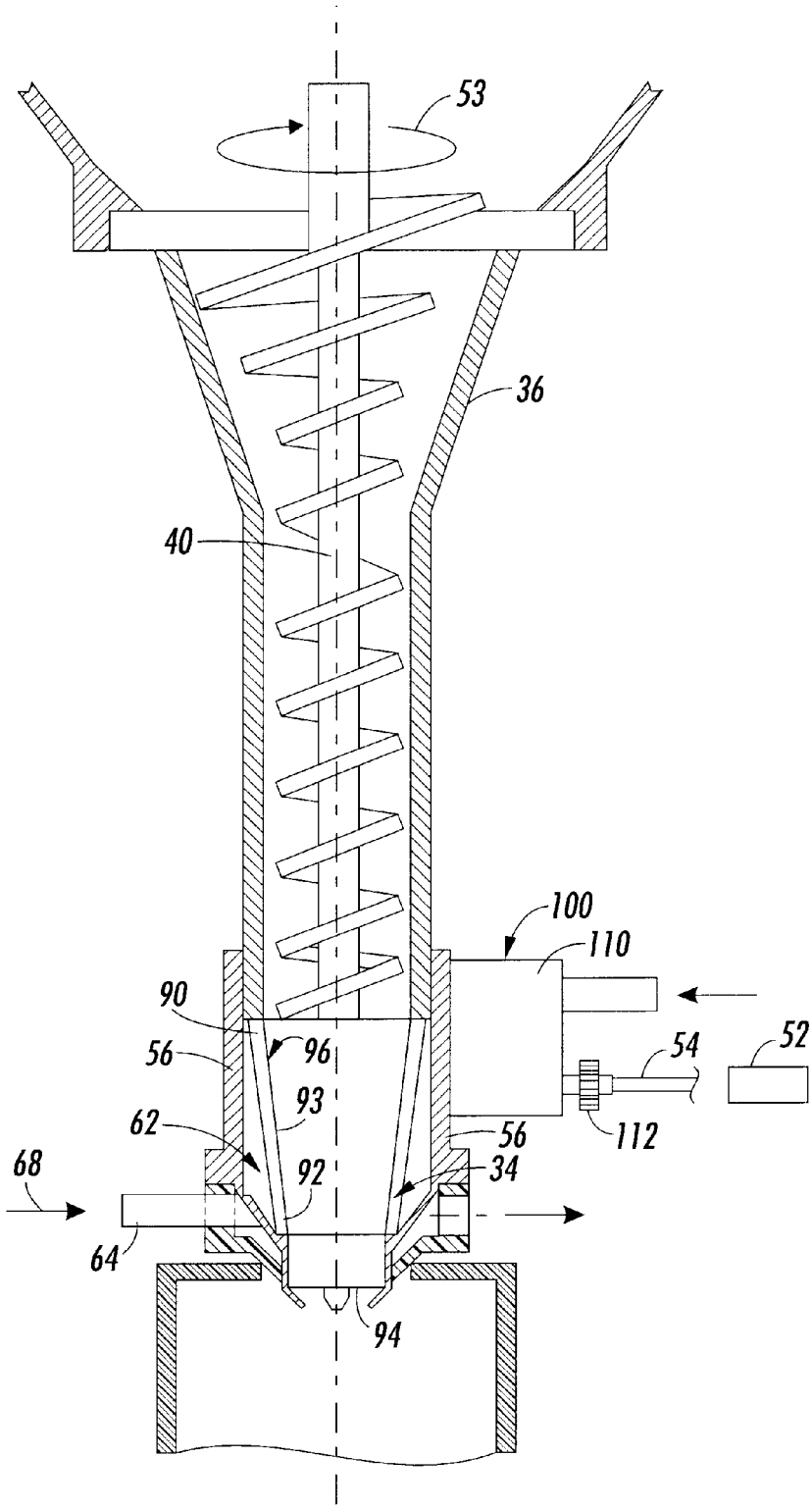
FIG. 2 is an elevational view of an enlarged portion of the filling apparatus of FIG. 1 showing the anti-dribbling nozzle device having the post-cutoff vibrator assembly in accordance with the present invention.

Referring now to FIGS. 1–2, the anti-dribbling nozzle 34 is shown in greater detail and includes a first end 90 adjacent to and mounted to the conduit 36, as well as a second end 92 opposed to the first end 90. The anti-dribbling nozzle 34 is secured to the conduit 36 in any suitable fashion. For example, as shown the first end 90 of the anti-dribbling nozzle 34 may be press fitted over the conduit 36 and is rigidly located within the housing 56. Between the first end 90 and the second end 92 of the anti-dribbling nozzle 34 is a central portion 93 of the nozzle. The central portion 93 has a hollow substantially conofrustrical shape or funnel like shape. As shown, the second or discharge end 92 includes a discharge opening 94 defined by a wall 96.

Thus in accordance with the present invention, the anti-dribbling nozzle 34 as shown includes a post-cutoff controllable vibrator assembly 100 that is mounted to the housing 56 for selectively enabling a clean cutoff of powder flowing into the container without post-cutoff dribbling. The post-cutoff controllable vibrator assembly 100 includes a miniature vibrator 110 and the controller 52 connected thereto for selectively and timely turning the miniature vibrator 110 on and off. The post-cutoff controllable vibrator assembly is for example a pneumatic vibrator assembly and also includes a regulator 112 that can be used to regulate a vibration amplitude thereof and/or vibration frequency thereof. The controller 52 that is connected in any manner well known to the regulator 112 for controlling the on and off cycling of the miniature vibrator 110, the amplitude and the frequency of its vibration.

Further, in the powder filling apparatus 10, a method of cleanly cutting off filling of the container 16 with powder 114 without post-cutoff dribbling of powder includes (a) stopping rotation of the auger 40 and movement of powder material 12 from the hopper 14; (b) stopping application of positive 68 pressure to the air porous walls 96 of the anti-dribbling nozzle 34; (c) applying negative 69 pressure to the air porous walls 96 of the anti-dribbling nozzle; (d) vibrating the housing 56 surrounding the air porous walls 96 of the anti-dribbling nozzle, and hence the air porous walls 96 themselves, for a brief period by turning on and operating the post-cutoff controllable vibrator assembly 100; and then (c) applying negative 69 pressure again to the air porous walls 96 of the anti-dribbling nozzle 34 following the vibrating step, thereby achieving a clean, dribbling-free opening 120, and enabling cleanly cutting off filling of the container without post-cutoff dribbling of powder. The vibrating step includes turning on and operating the miniature vibrator 110 of the post-cutoff controllable vibrator assembly 100.

Thus after the auger 40 stops rotating and applied pressure is switched from positive 68 to negative or vacuum 69, the vibration of the miniature vibrator is applied in a short burst of vibrations 116 for a period of 92–300 milli seconds to the housing 56 and hence to the nozzle 34 for shaking out the powder or toner particles 118 that are on the nozzle walls or that are not firmly held by the vacuum 69 on the nozzle air porous walls 96. The short burst of vibrations 116 thus can be applied after turning off the negative pressure or vacuum 69 during which there are no particles being held by such vacuum to the walls. The short burst of vibrations thus can also be applied without turning off the negative pressure or vacuum thus allowing a thin layer of about 3–5 mm to be held by such vacuum to the walls. In this case, the negative pressure or vacuum 69 will thus be maintained during and after such a short burst of vibration.

As can be seen, there has been provided a method and an apparatus for directing toner from a hopper containing a supply of toner to fill as well as cleanly cutoff filling of a container without post-cutoff dribbling. The apparatus for the method includes (a) a conduit member connected to the hopper and having a discharging end for permitting a toner to be moved therethrough; (b) a conveyor device located at least partially within the conduit member for moving the toner from the hopper in a toner moving direction towards the container; (c) a nozzle device including a nozzle member for directing the toner from the conveyor to cleanly fill the container. The nozzle member is mounted within a housing and has a first end connected to the discharge end of the conduit member and a second and opposite end for dispensing moving toner into the container. The nozzle member device includes a post-cutoff controllable vibrator assembly connected to a controller for selectively enabling clean cutoff of powder flowing into the container without post-cutoff dribbling.

While the embodiment disclosed herein is preferred, it will be appreciated from this teaching that various alternative, modifications, variations or improvements therein may be made by those skilled in the art, which are intended to be encompassed by the following claims:

1. An apparatus for directing powder from a hopper containing a supply of powder to fill as well as cleanly cutoff filling of a container without post-cutoff dribbling, the apparatus comprising:

(a) a conduit member connected to the hopper and having a discharging end for permitting a quantity of powder to be moved therethrough;

(b) a conveyor device located at least partially within said conduit member for moving the quantity of powder from the hopper in a powder moving direction towards the container; and (c) an anti-dribbling nozzle device for directing the powder from said conveyor device to cleanly fill the container, said anti-dribbling nozzle device including a nozzle member having a first end connected to said discharge end of said conduit member and a second and opposite end for dispensing moving powder Into the container, said anti-dribbling nozzle device including means for selectively applying and stopping positive air pressure and alernatively applying negative pressure to walls of said nozzle member and a post-cutoff controllable vibrator assembly for selectively enabling clean cutoff of powder flowing into the container without post-cutoff dribbling.

2. The apparatus of claim 1, wherein said post-cutoff controllable vibrator assembly includes a miniature vibrator.

3. The apparatus of claim 1, wherein said post-cutoff controllable vibrator assembly includes a miniature vibrator and a controller connected thereto for selectively and timely turning said miniature vibrator on and off.

4. The apparatus of claim 3, wherein said post-cutoff controllable vibrator assembly includes a power means regulator.

5. The apparatus of claim 4, wherein said controller and regulator selectively control said miniature vibrator by regulating a vibration arnplitude thereof.

6. The apparatus of claim 4, wherein said controller and regulator selectively control said miniature vibrator by regulating a vibration frequency thereof.

7. The apparatus of claim 3, wherein said miniature vibrator comprises a pneumatic miniature vibrator.

8. In a powder filling apparatus including a hopper, a rotatable auger for moving powder material from said hopper towards a container to be filled, an anti-dribbling nozzle device including a nozzle member for inserting into the container, means for applying positive and negative air pressure to walls of said nozzle member, and a controller, a method of cleanly cutting off filling of the container from a filling cycle without post-cutoff dribbling of powder, the method comprising:

(a) stopping rotation of said auger and movement of powder material from said hopper;

(b) stopping application of positive pressure through walls of said nozzle member;

(c) applying negative pressure to said walls of said nozzle member;

(d) vibrating said walls of said nozzle member for a brief period by turning on and operating a post-cutoff controllable vibrator assembly connected to said walls of said nozzle member; and (e) applying negative pressure again to said walls of said nozzle member following said vibrating step, thereby enabling cleanly cutting off filling of the container without post-cutoff dribbling of powder.

9. The method of claim 8, wherein said vibrating step includes turning on and operating a miniature vibrator of said post-cutoff controllable vibrator assembly.

10. The method of claim 8, wherein said post-cutoff controllable vibrator assembly includes a miniature vibrator and a controller connected thereto for selectively and timely turning said miniature vibrator on and off.

11. The method of claim 10, wherein said postcutoff controllable vibrator assembly includes a regulator.

12. The method of claim 11, wherein said controller and regulator selectively control said miniature vibrator by regulating a vibration amplitude thereof.

13. The method of claim 11, wherein said controller and regulator selectively control said miniature vibrator by regulating a vibration frequency thereof.

* * * * *